US008365963B2

(12) United States Patent
McCullough et al.

(10) Patent No.: US 8,365,963 B2
(45) Date of Patent: Feb. 5, 2013

(54) FLUID DISPENSER SELECTIVELY SECURED TO A COUNTERTOP

(75) Inventors: Anthony McCullough, Greensboro, NC (US); Ron Shuster, Greensboro, NC (US); Lori Huffman, Greensboro, NC (US)

(73) Assignee: Evonik Stockhausen, LLC, Greensboro, NC (US)

( * ) Notice: Subject to any disclaimer, the term of this patent is extended or adjusted under 35 U.S.C. 154(b) by 0 days.

(21) Appl. No.: 13/216,875

(22) Filed: Aug. 24, 2011

(65) Prior Publication Data

US 2012/0006851 A1 Jan. 12, 2012

Related U.S. Application Data

(63) Continuation-in-part of application No. 12/022,212, filed on Jan. 30, 2008, now Pat. No. 8,020,731.

(51) Int. Cl.
*B67D 7/06* (2010.01)

(52) U.S. Cl. ..... 222/180; 222/153.01; 222/173; 248/551; 248/309.1

(58) Field of Classification Search ..... 222/153.01, 222/173, 180; 248/551, 640, 678, 680, 309.1, 248/310–312.1
See application file for complete search history.

(56) References Cited

U.S. PATENT DOCUMENTS

| | | | | |
|---|---|---|---|---|
| 231,597 | A | 8/1880 | Matthews | 222/173 |
| 2,850,079 | A | 9/1958 | Prushnok | |
| 3,845,884 | A | 11/1974 | Hall et al. | 222/173 |
| 4,258,854 | A | 3/1981 | Wright | 215/21 |
| 4,280,638 | A * | 7/1981 | Keihm | 222/180 |
| 4,869,381 | A * | 9/1989 | Agner | 215/11.1 |
| 5,148,948 | A * | 9/1992 | Granville et al. | 222/173 |
| 5,445,288 | A | 8/1995 | Banks | |
| 5,480,068 | A | 1/1996 | Frazier et al. | |
| 5,829,607 | A | 11/1998 | Ibrahim | |
| 6,082,586 | A | 7/2000 | Banks | |
| 6,142,342 | A | 11/2000 | Lewis | 222/180 |
| 6,250,470 | B1 | 6/2001 | Mackenzie | 206/579 |
| 6,398,050 | B1 | 6/2002 | Allora | |
| D470,401 | S * | 2/2003 | Genoa et al. | D9/503 |
| 6,520,470 | B1 * | 2/2003 | Chan | 248/346.04 |

(Continued)

FOREIGN PATENT DOCUMENTS

| | | | |
|---|---|---|---|
| EP | 1103212 | A1 | 5/2001 |
| GB | 2414466 | A | 11/2005 |

(Continued)

OTHER PUBLICATIONS

International Search Report mailed on May 6, 2009 in PCT/US2009/032244.

(Continued)

*Primary Examiner* — Kevin P Shaver
*Assistant Examiner* — Andrew P Bainbridge
(74) *Attorney, Agent, or Firm* — Smith Moore Leatherwood LLP; Clara R. Cottrell

(57) ABSTRACT

A fluid dispenser formed of a bottle for housing the fluid, a discharge mechanism for discharging fluid from the bottle, and a protrusion that is connected to and extends from the bottom of the bottle. The fluid dispenser may have a fastener and a stabilizer. The protrusion has a diameter that is smaller than the diameter of the bottom wall of the bottle. The bottle is capable of standing upward on a horizontal surface without the use of a separate base or mount when the protrusion extends into an aperture in the horizontal surface such that the bottom wall of the bottle rests on the horizontal surface. Further, a method of installing a fluid dispenser.

22 Claims, 5 Drawing Sheets

U.S. PATENT DOCUMENTS

| | | | | |
|---|---|---|---|---|
| 6,705,492 | B2 | 3/2004 | Lowry | |
| 6,820,770 | B2 * | 11/2004 | Makino et al. | 222/180 |
| 6,905,038 | B2 | 6/2005 | Lopez | |
| 6,910,604 | B2 * | 6/2005 | Gugliotti et al. | 222/179.5 |
| 7,992,714 | B1 * | 8/2011 | Devault et al. | 206/564 |
| 2002/0070238 | A1 * | 6/2002 | Pritchett et al. | 222/189.11 |
| 2006/0144861 | A1 | 7/2006 | Harrison et al. | |

FOREIGN PATENT DOCUMENTS

| | | | |
|---|---|---|---|
| GB | 2435874 | A | 9/2007 |
| WO | 2004/004529 | A1 | 1/2004 |

OTHER PUBLICATIONS

Written Opinion mailed on May 6, 2009 in PCT/US2009/032244.

* cited by examiner

FLUID DISPENSER SELECTIVELY SECURED TO A COUNTERTOP

This application is a continuation-in-part application of U.S. application Ser. No. 12/022,212 filed on Jan. 30, 2008, which issued as U.S. Pat. No. 8,020,731 on Sep. 20, 2011, the disclosure of which is expressly incorporated herein by reference.

The present invention is directed towards a dispenser that can be mounted on a countertop.

BACKGROUND OF THE INVENTION

Many public bathrooms in business establishments such as offices and restaurants have soap dispensers that include soap-filled bottles mounted under the counter next to the sinks. The dispensers have spouts that are disposed above the counter and are attached to the under-mounted bottles so that soap can be pumped from the respective bottles. Typically, large holes are bored into the counter so that the spout and bottle can be securely attached to one another to form the dispenser assembly. There are several drawbacks to this type of dispenser assembly. First, it is difficult to determine when the under-mounted soap bottle is empty or running low on soap because the bottle is not visible above the counter. Typically, a person has to go underneath the counter and unscrew the bottle to determine the amount of soap in it, which is labor-intensive and can be unsanitary. Also, the soap bottles are typically not disposable and must be refilled with soap. The process of pouring soap into the bottles can also be labor-intensive and messy.

Many operators of public bathrooms have explored replacing the prior art soap dispensers as described above with new soap dispensers that do not have the noted drawbacks. For example, some operators have used stand-alone soap dispensers that rest on top of but are not affixed to the countertop. Those dispensers, however, are often stolen by consumers who use them in their homes. Further, when the prior art dispensers are replaced with new means for delivering soap, the hole in the counter from the prior art dispenser remains and can be very unattractive.

Accordingly, there is a need in the art for a soap dispenser system that can easily be refilled or replaced and that utilizes existing counter holes that were used for the prior art soap dispensers.

DETAILED DESCRIPTION OF THE INVENTION

Figure 1:
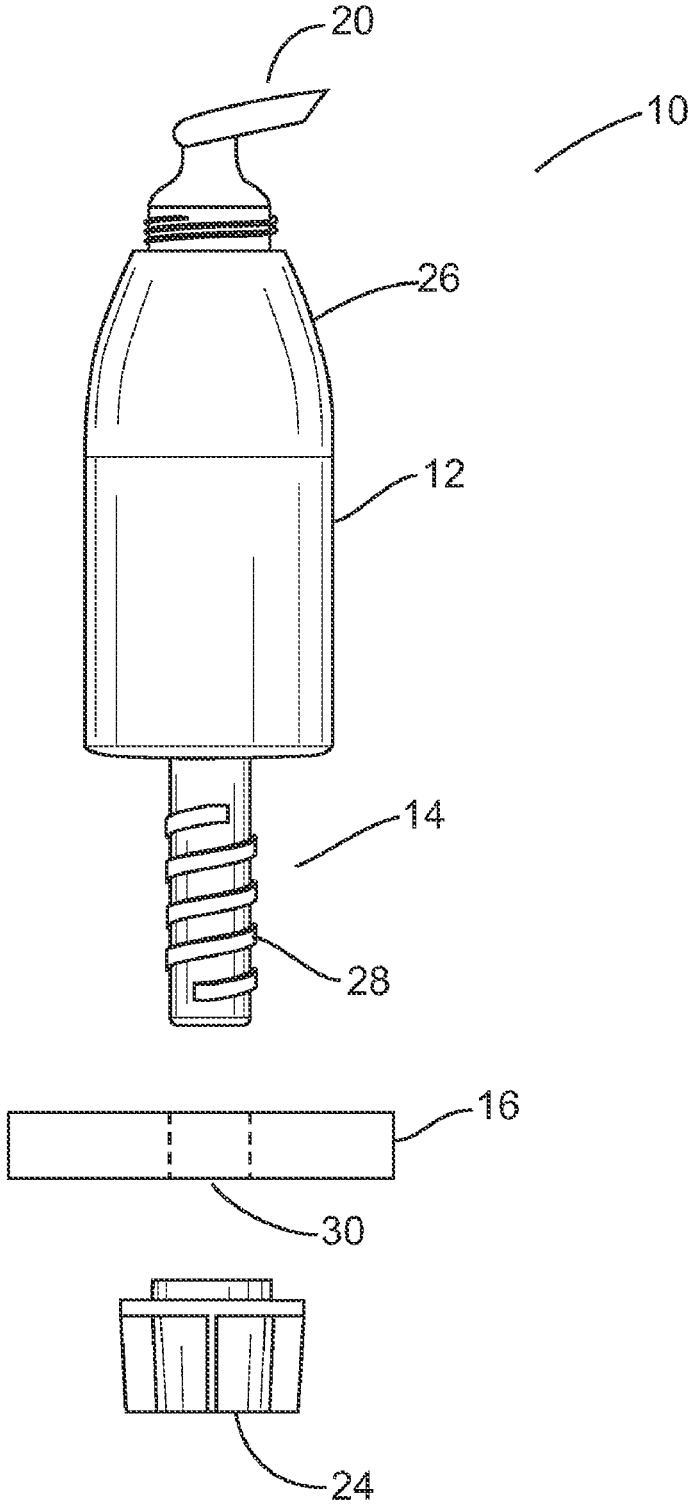
FIG. 1 is an exploded perspective view of a dispenser in accordance with an embodiment of the present invention.
Figure 2:
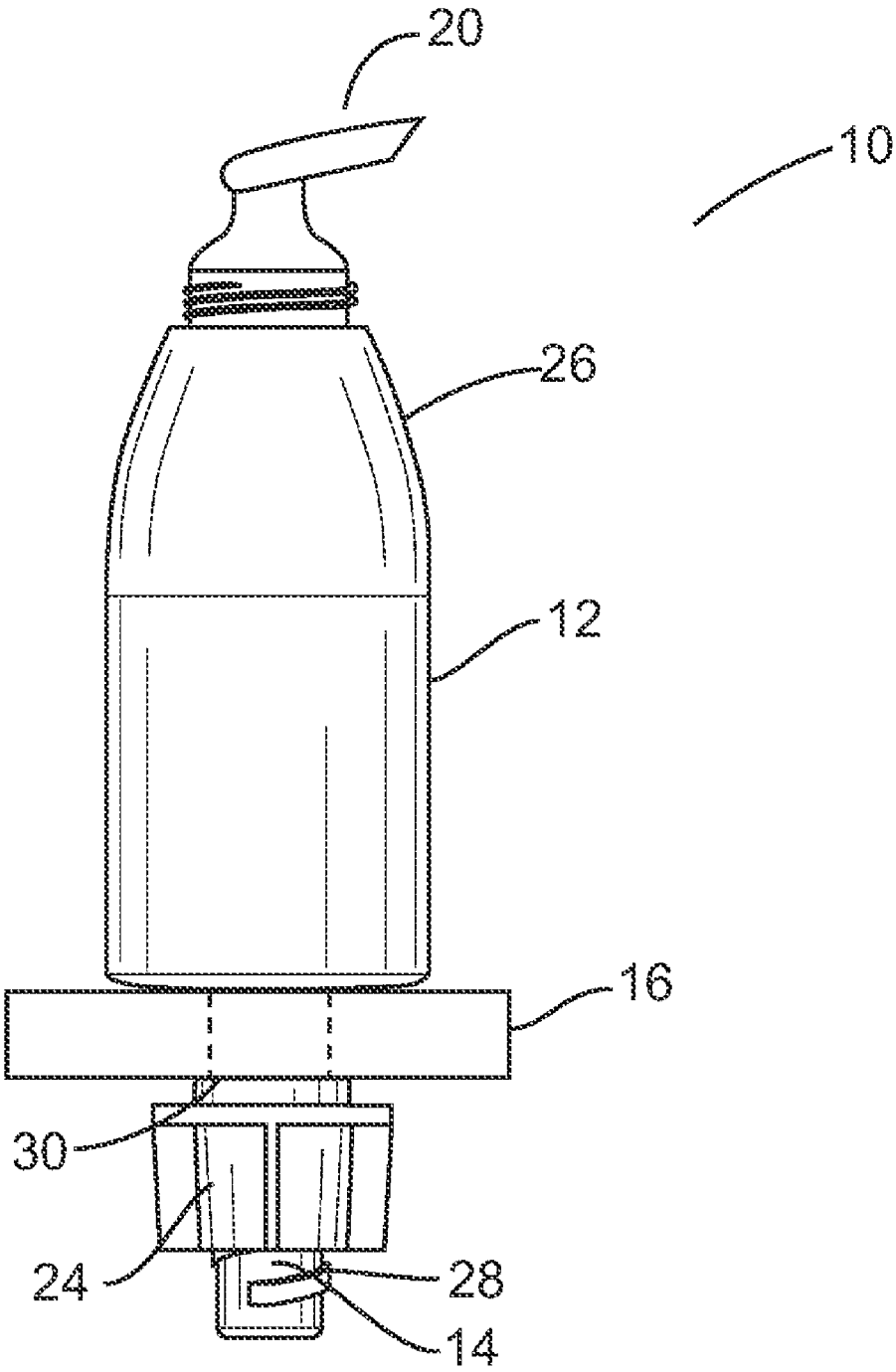
FIG. 2 is a perspective view of an installed dispenser in accordance with an embodiment of the present invention.
Figure 3:
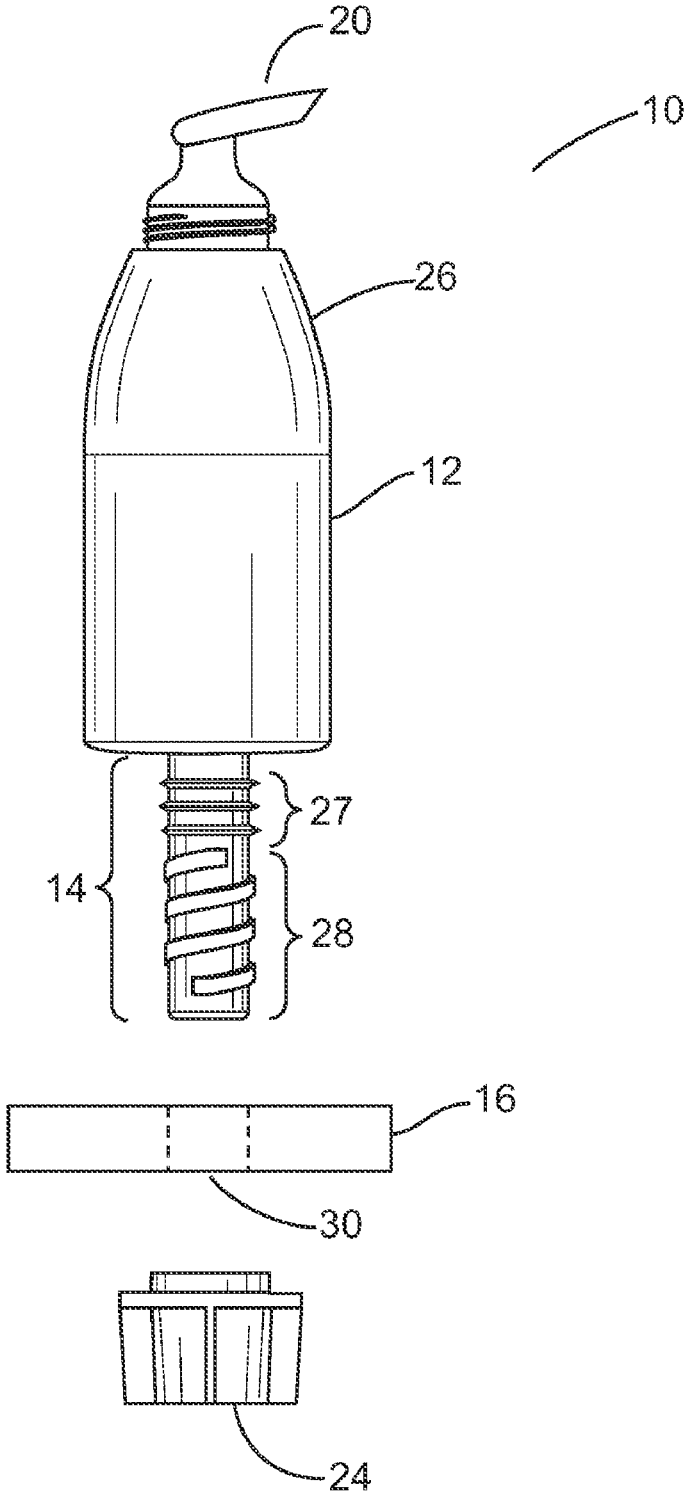
FIG. 3 is an exploded perspective view of a dispenser in accordance with an embodiment of the present invention.

The present invention is a dispenser, such as a soap dispenser, that is easy to replace or refill and may fit into holes in counters that were utilized for prior art soap dispenser systems.

As shown in FIGS. 1-5, the dispenser 10 of the present invention includes a bottle 12, a discharge mechanism such as a spout 20 or a foaming pump that may be removably or permanently attached to the bottle 12, and protrusion such as an elongated stud 14 that extends from the bottom 22 of the bottle 12. When the dispenser 10 of the present invention is installed, the elongated stud 14 may be inserted into the hole 30 in the counter 16 that may have been previously bored to accommodate a prior art dispenser assembly. The elongated stud 14 may be long enough to extend below the depth of the counter 16 so that the bottom 22 of the bottle 12 rests flush on top of the counter 16.

Figure 4:
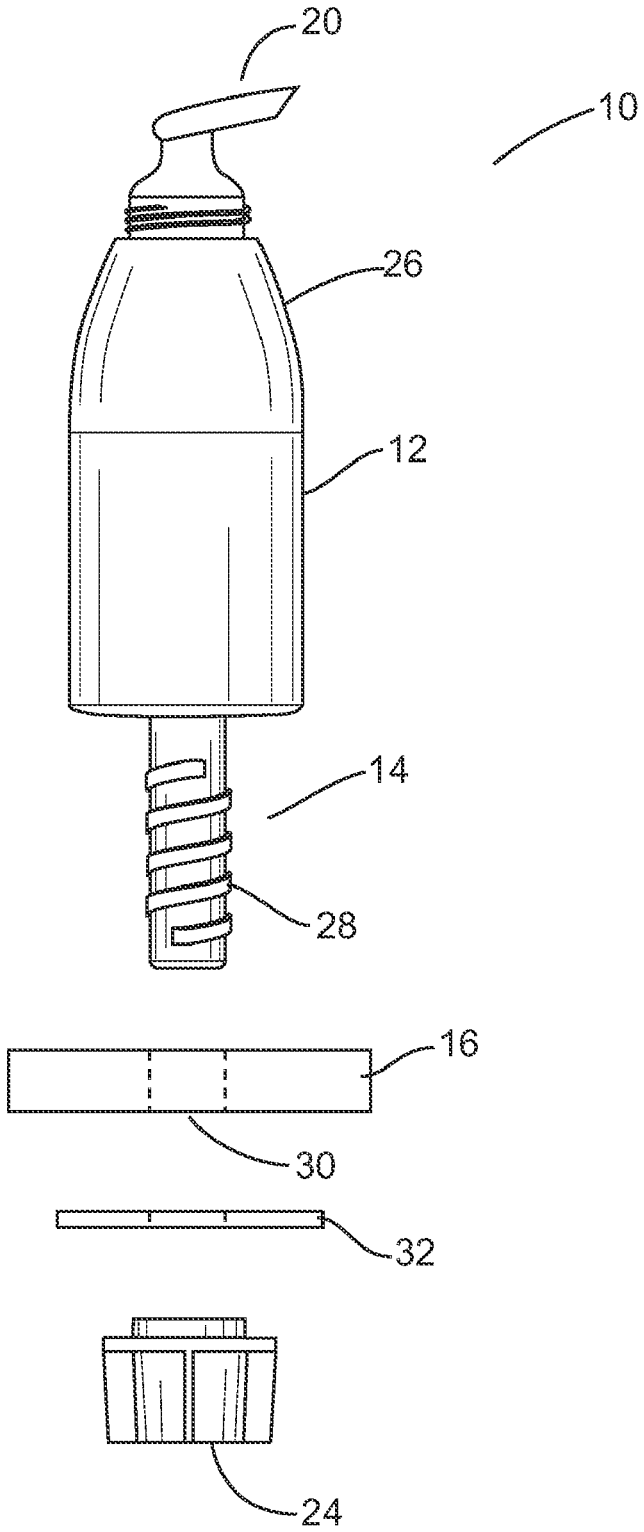
FIG. 4 is an exploded perspective view of a dispenser in accordance with an embodiment of the present invention.
Figure 5:
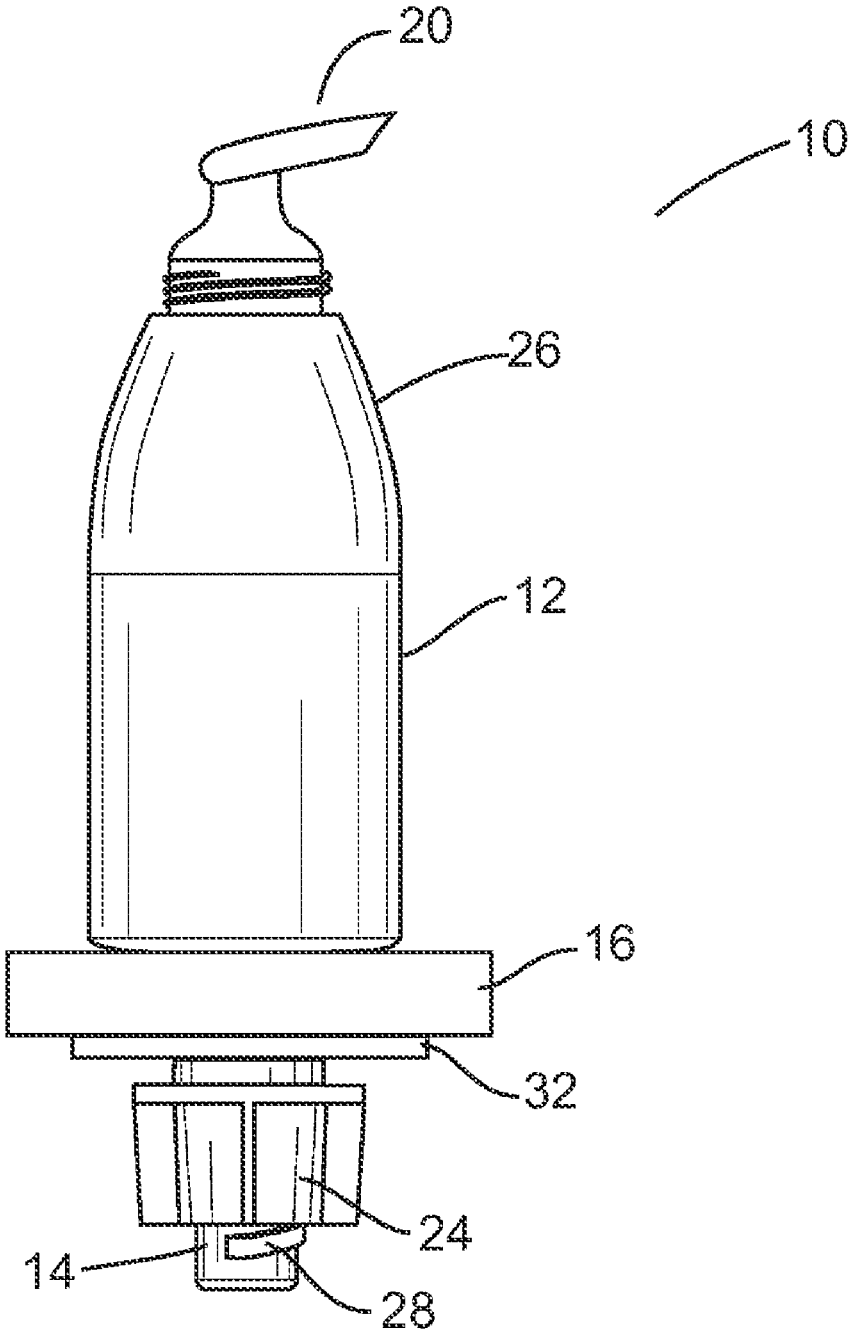
FIG. 5 is a perspective view of an installed dispenser in accordance with an embodiment of the present invention.

In one embodiment of the present invention, as shown in FIGS. 4 and 5, the dispenser may include a fastener 32, a stabilizer 24 or both. The fastener 32 and the stabilizer 24 may be encompassed in an element such as, but not limited to, one or more wing nuts. The fastener 32 and the stabilizer 24 may be affixed to one another in a permanent, semi-permanent or removable manner using mechanical or chemical means. For example, one or both of the fastener 32 and the stabilizer 24 may include an adhesive to facilitate the bonding of the fastener 32 and the stabilizer 24 to each other. In another example, one or both of the fastener 32 and the stabilizer 24 may be adapted such that the physical contact of the elements would cause the fastener 32 and the stabilizer 24 to bond, such as a locking nuts and/or washers.

The stabilizer 24 may be affixed to the dispenser in such a way that it may be removed and reaffixed one or more times. The stabilizer 24 may be adhered to the protrusion 14, the horizontal surface 16 or both. The stabilizer 24 may be bonded to the protrusion 14, the horizontal surface 16 or both through mechanical or chemical means. For example, the stabilizer 24, the protrusion 14 and/or the horizontal surface 16 may include an adhesive that facilitates the bonding of the stabilizer 24 to the protrusion 14, the horizontal surface 16 or both. The stabilizer 24 may be mounted on the protrusion 14. In one embodiment, the stabilizer 24 may include internal threads, such as, for example, a wing nut, adapted to allow the stabilizer 24 to threadingly engage external threads 28 on the protrusion 14. The wing nut may be further adapted to bond to the fastener 32.

The fastener 32 may be securedly affixed to the horizontal surface in a permanent or semi-permanent manner. The fastener 32 may be adhered to the protrusion 14, the horizontal surface 16 or both. The fastener 32 may be bonded to the protrusion 14, the horizontal surface 16 or both through mechanical or chemical means. For example, the fastener 32, the protrusion 14 and/or the horizontal surface 16 may include an adhesive that facilitates the bonding of the fastener 32 to the protrusion 14, the horizontal surface 16 or both. In one embodiment, the fastener 32 may be one or more washers having at least one adhesive side to facilitate bonding the fastener 32 to the under side of a horizontal surface 16. In one aspect, the one or more washers may have at least one adhesive side to facilitate bonding to the stabilizer 24.

In one embodiment of the present invention, the elongated stud 14 may be ribbed 27 to create a frictional engagement between the stud 14 and the hole 30 in the counter 16. One embodiment of the external ribs 27 can be seen in FIG. 3. The elongated stud 14 may also be threaded 28 so that it can be screwed into a stabilizer 24 having internal threads, such as, but not limited to, a wing nut, underneath the counter 16 to provide an additional means of securing the dispenser 10 to the counter 16. The stabilizer 24 may also help to center the stud 14 in the hole 30 if the diameter of the hole 30 is bigger than the diameter of the stud 14.

In another embodiment of the present invention, the upper portion of the bottle 12 is tapered towards the spout 20 so that the user's hands are able to fit under the spout 20 when the soap is dispensed from the bottle 12.

Because the bottle 12 rests on top of the counter 16, an operator may easily determine if the bottle 12 is empty or running low on soap without having to go underneath the counter 16 to view and/or remove the bottle 12. For example, in one aspect of the present invention, the bottle 12 may be formed of transparent or semi-transparent material so that the amount of soap within the bottle 12 may be easily viewed above the counter 16. It should be understood, however, that the components of the dispenser 10 of the present invention may be formed of any type of material, such as plastic, glass, or metal. In another aspect of the present invention, the operator may remove the spout 20 from the bottle 12 to look into the bottle 12 to determine the amount of soap therein without having to go under the counter 16. When the dispenser 10 of the present invention is empty, the operator may easily replace the entire dispenser 10 with a new dispenser that may be pre-filled with soap or liquid. If the operator desires to refill the bottle 12, he or she may simply remove the spout 20 and refill the bottle 12 on top of the counter 16. Therefore, the operator is able to easily replace or refill the dispenser 10 without having to go underneath the counter. It should be understood that the dispenser 10 of the present invention is not limited to dispensing soap. Rather, the dispenser 10 may dispense any type of fluid or semi-fluid material The dispenser 10 of the present invention is also theft-deterrent in that the elongated stud 14 makes it difficult for a consumer to use the dispenser 10 in a different location because the dispenser 10 is not stable resting on top of a planar surface that does not have a hole through which the elongated stud 14 can extend.

The present invention additionally includes a method for installing the dispenser 10 on a horizontal surface 16 such as, but not limited to, a counter, by inserting the protrusion 14 through an aperture 30 in the horizontal surface 16 and affixing a fastener 32 to the horizontal surface and a stabilizer 24 to the dispenser. The dispenser 10 installed by this method may be any embodiment of a dispenser 10 as described in the present application having a protrusion 14 extending from the bottom of the dispenser 10 and the dispenser 10 being adapted to stand upward on a horizontal surface 16. The dispenser 10 may be adapted to stand upward on a horizontal surface 16 without the use of a separate base. In one aspect of the invention, the fastener 32 is securedly affixed to the horizontal surface 16 in a permanent or semi-permanent manner by being bonded to the horizontal surface 16 facilitated by the use of an adhesive. In another aspect of the invention, the stabilizer 24 may be mounted to the protrusion 16. In one aspect, the stabilizer may be removably affixed to the protrusion 16, for example, by being threaded onto the external threads 28 of the protrusion 14. In a further aspect, the stabilizer 24 and/or the fastener 32 may include an adhesive to facilitate bonding the stabilizer 24 and the fastener 32 together. In another aspect of the invention, an adhesive is applied to the fastener 32 and/or the stabilizer to facilitate the bonding of the fastener 32 to the stabilizer 24, the fastener 32 to the horizontal surface 24, and/or the stabilizer 24 to the protrusion 14. In yet another aspect, the fastener 32 and the stabilizer 24 may be a single element which is affixed to the protrusion 14 and the horizontal surface 16. In yet another aspect, the fastener 32 and the stabilizer 24 may be the same type of element, such as a plurality of wing nuts or washers.

In view of the foregoing, the dispenser of the present invention is easy to replace or refill without having to go underneath the counter. The dispenser of the present invention may also be used to replace a prior art dispenser by utilizing the existing hole bored in the counter for the prior art dispenser. Thus, the dispenser of the present invention does not require use of a separate mount or base to hold or support the dispenser.

Certain modifications and improvements will occur to those skilled in the art upon a reading of the forgoing description. All such modifications and improvements of the present invention have been deleted herein for the sake of conciseness and readability.

What is claimed is:

1. A method for installing a fluid dispenser on a horizontal surface comprising:

providing a fluid dispenser, said fluid dispenser comprising:

a bottle for housing the fluid, the bottle having a bottom wall;

a discharge mechanism that is configured to discharge fluid from the bottle; and a protrusion that is connected to and extends from the bottom wall of the bottle;

inserting said protrusion through an aperture in said horizontal surface, wherein said horizontal surface is defined by a top surface and a bottom surface, such that when said protrusion is inserted into said aperture said bottle stands upward on the top surface of said horizontal surface without the use of a separate base;

affixing a fastener to the bottom surface of said horizontal surface; and affixing a stabilizer to said dispenser.

2. The method according to claim 1, wherein the affixing a stabilizer step comprises removably affixing said stabilizer to said dispenser.

3. The method according to claim 1, wherein said stabilizer is a wing nut.

4. The method according to claim 1, wherein the affixing a stabilizer step comprises threading said stabilizer onto said protrusion;

wherein said stabilizer comprises internal threads; and wherein said protrusion comprises external threads.

5. The method according to claim 1, wherein the affixing a fastener step comprises securedly affixing said fastener to said horizontal surface.

6. The method according to claim 5, wherein the affixing a fastener step comprises bonding said fastener to said horizontal surface.

7. The method according to claim 6, wherein said fastener comprises an adhesive to facilitate bonding said fastener to said horizontal surface.

8. The method according to claim 1, wherein said fastener comprises a washer.

9. The method according to claim 1, further comprising securedly affixing said fastener to said stabilizer.

10. The method according to claim 9, wherein the affixing a fastener to a stabilizer step comprises bonding said fastener to said stabilizer.

11. The method according to claim 10, wherein one or both of said fastener and said stabilizer comprise an adhesive to facilitate bonding said fastener to said stabilizer.

12. The method according to claim 1, wherein said stabilizer and said fastener are the same type of element.

13. The method according to claim 1, wherein said stabilizer and said fastener are a single element.

14. The method according to claim 1, further comprising the step of applying an adhesive to said fastener.

15. The method according to claim 1, further comprising the step of applying an adhesive to said stabilizer.

16. A device for dispensing fluid comprising:

a bottle for housing the fluid, the bottle having a bottom wall;

a discharge mechanism that is configured to discharge fluid from the bottle;

a protrusion that is connected to and extends from the bottom wall of the bottle, the protrusion having a diameter that is smaller than the diameter of the bottom wall of the bottle and the protrusion being configured to be inserted in an aperture in a horizontal surface;

a fastener adapted to be securedly affixed to an underside of said horizontal surface; and a stabilizer adapted to be mounted on the protrusion underneath said horizontal surface to secure the position of the device;

wherein the bottle is adapted to stand upward on said horizontal surface without the use of a separate base when the protrusion extends into an aperture in the horizontal surface such that the bottom wall of the bottle rests on the horizontal surface; and wherein said protrusion further comprises ribs on the outside of the protrusion to create a frictional engagement when the protrusion is inserted into the aperture in the horizontal surface.

17. The device according to claim 16, wherein said fastener is bonded to said horizontal surface.

18. The device according to claim 16, wherein said fastener is bonded to said stabilizer.

19. The device according to claim 16, wherein said stabilizer is a wing nut.

20. The device according to claim 16, wherein said fastener is a washer.

21. The device according to claim 16, wherein one or both of said fastener and said stabilizer comprise an adhesive.

22. The device according to claim 16, wherein said bottle stands upward on said horizontal surface without the use of a separate base.

* * * * *